US005267516A

United States Patent [19]

Abrahamson et al.

[11] Patent Number: 5,267,516

[45] Date of Patent: Dec. 7, 1993

[54] PALLET AND METHOD FOR LOADING PALLETS

[75] Inventors: Lars A. Abrahamson, Stockholm; Lennart W. Castwall, Täby; Sven-Gunnar Ericsson, Sundbyberg, all of Sweden

[73] Assignee: Aktiebolaget Electrolux, Sweden

[21] Appl. No.: 708,686

[22] Filed: May 31, 1991

[30] Foreign Application Priority Data

Jun. 12, 1990 [SE] Sweden ..... 9002089

[51] Int. Cl.[5] ..... B65D 19/00

[52] U.S. Cl. ..... 108/51.1; 108/54.1; 206/597

[58] Field of Search ..... 108/51.1, 55.1, 54.1, 108/56.1; 206/597, 600

[56] References Cited

U.S. PATENT DOCUMENTS

| | | | |
|---|---|---|---|
| 3,650,224 | 3/1972 | Petix et al. | 108/51.1 |
| 3,942,670 | 3/1976 | Mingus et al. | 108/51.1 X |
| 4,095,769 | 6/1978 | Fengels | 108/54.1 X |
| 4,206,846 | 6/1980 | Connolly | 108/55.1 X |
| 4,287,991 | 9/1981 | Donnelly . | |
| 4,509,432 | 4/1985 | Win | 108/51.1 |
| 4,690,360 | 9/1987 | Looker | 108/51.1 X |
| 4,694,962 | 9/1987 | Taub | 108/54.1 X |
| 4,735,321 | 4/1988 | Day | 108/55.1 X |
| 4,824,050 | 4/1989 | Courter | 108/55.1 X |

FOREIGN PATENT DOCUMENTS

| | | | |
|---|---|---|---|
| 3528959 | 2/1990 | Fed. Rep. of Germany . | |
| 2463068 | 3/1981 | France | 108/54.1 |
| 1149811 | 4/1969 | United Kingdom | 108/54.1 |

*Primary Examiner*—Jose V. Chen

*Attorney, Agent, or Firm*—Pearne, Gordon, McCoy & Granger

[57] ABSTRACT

A method for transporting load units 10 on pallets 11 where each load unit is supported by a separate pallet. Two or several pallets with load units are, before transportation, placed close to each other and fixed to each other in order to form a combined load during transportation in which the pallets together form a unit to simplify handling of the combined load. A pallet for accomplishing the method described above is also described.

10 Claims, 1 Drawing Sheet

PALLET AND METHOD FOR LOADING PALLETS

BACKGROUND OF THE INVENTION

1. Field of the Invention

The invention relates generally to a method for packing and transporting goods on pallets, and more particularly to a pallet and a method wherein pallets can be individually loaded and then combined to form a single load unit which can be handled and transported more efficiently.

2. Description of Related Art

Traditionally, large goods such as refrigerators, freezers, stoves, dishwashers, etc., commonly referred to as white goods, are transported by truck from the manufacturer to a retailer or directly to a customer. To protect the goods during transportation, they are generally wrapped with shock absorbing materials such as cellulose plastic plates, provided with a frame of wood, and wrapped with an outer film of shrinkable plastic or the like. Each individual good is then placed on a pallet and separately loaded onto the truck.

This traditional method of loading and transporting goods has some drawbacks associated with it. Each of the individual goods must be loaded and unloaded separately which requires more labor than would otherwise be needed if several goods could be combined into a single load. Because the goods are separately provided with protective materials for transportation, more protective materials are required than would be needed if several goods could be combined into a single load. Also, individually protected goods require more space than would a combined load, which results in less effective utilization of truck space than would otherwise be possible. For example, the standard width and depth of 60 cm for white goods permits only three such goods, after being prepared for shipment, to be loaded beside each other across a truck bed having a width of 260 cm.

A pallet having sections which can be easily broken away from the original pallet with each section being capable of supporting a load which can be individually transported on the section after it is broken away is described in U.S. Pat. No. 4,287,991. One disadvantage of the breakaway pallet is that the individual sections cannot be brought back together for reuse as a combined load pallet. Moreover, the arrangement does not facilitate handling of individually loaded pallets before combining them into a single load for transportation.

German Patent No. 3,528,959 describes a pallet arrangement comprising several sections which are locked to each other before transportation. This arrangement, because of the large number of parts involved, is relatively difficult to use.

SUMMARY OF THE INVENTION

These and other disadvantages in the prior art are solved by provision of a combinable pallet having interlocking projections and recesses which, in combination with a single strap, permits separately loaded pallets to be locked together so they can be handled and transported as a single combined load.

The invention makes it possible to reduce the total thickness of the protecting layers normally surrounding the goods by eliminating the need for such material between abutting surfaces of the individual load units comprising the combined load. By eliminating the need for at least some of the protective material normally used, better utilization of the load space during transportation is generally achieved.

The purpose of the invention is to achieve these advantages by a simplified method and by means of a less complicated pallet than those provided in the prior related art.

DESCRIPTION OF THE PREFERRED EMBODIMENT

Figure 1:
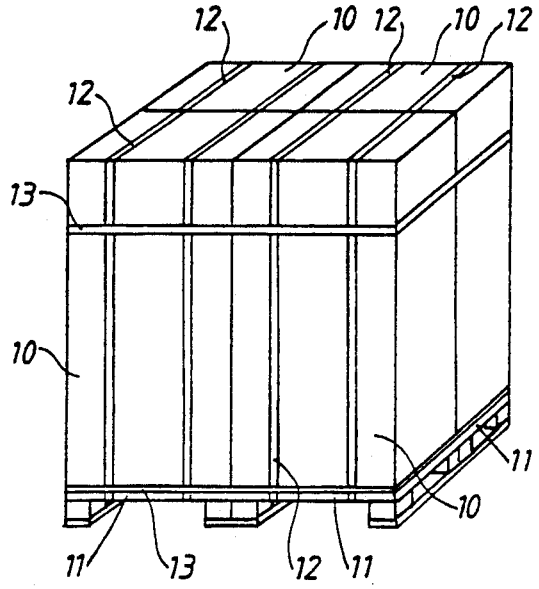
FIG. 1 is a perspective view showing four separate loaded pallets arranged to form a combined load in accordance with the preferred embodiment of the invention.

Referring to FIG. 1, a load unit 10, such as a refrigerator enclosed in shrinkable plastic, is loaded onto a pallet 11 and fastened to it with a strap 12 or the like. Several loaded pallets, preferably four, are placed next to each other so that the edges of the pallets abut each other and are locked to each other with regard to vertical movements. A combined load is created by wrapping one or more straps 13 around the load units 10 which are already strapped to the individual pallets. The combined load which preferably consists of four load units in a two by two arrangement can be handled and transported together as a single package thereby reducing the time and labor required for loading and unloading. Because the combined load does not require layers of shock absorbing material between each load unit, space is saved which results in efficient utilization of the available load area in trucks or other transportation vehicles.

Figure 2:
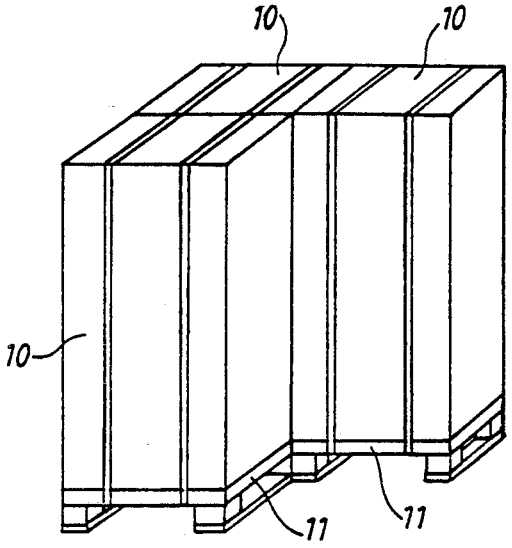
FIG. 2 is a perspective view showing a combined load which has been opened and wherein one of the loaded pallets has been removed.

After the combined load is unloaded at its destination, the straps 13 can be removed and the individual load units can be handled separately as is shown by example in FIG. 2 wherein a single load unit has been removed.

Figure 3:
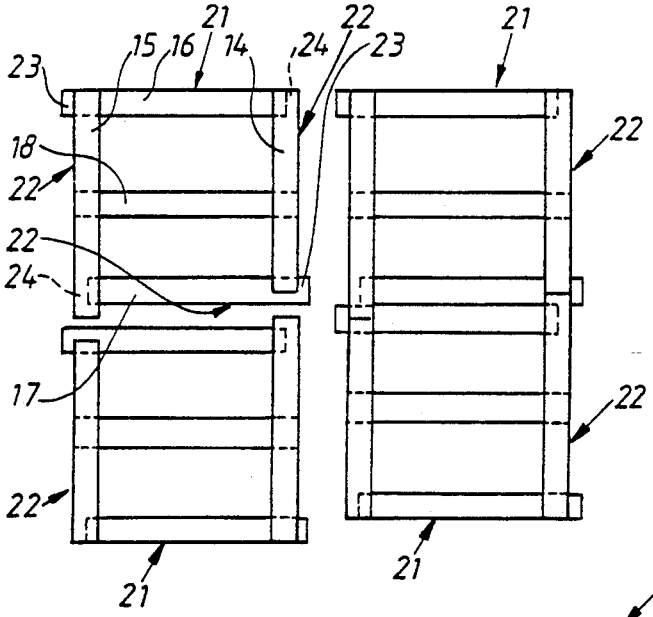
FIG. 3 is a top view of four pallets showing the required orientation for creating a combined load.
Figure 4:
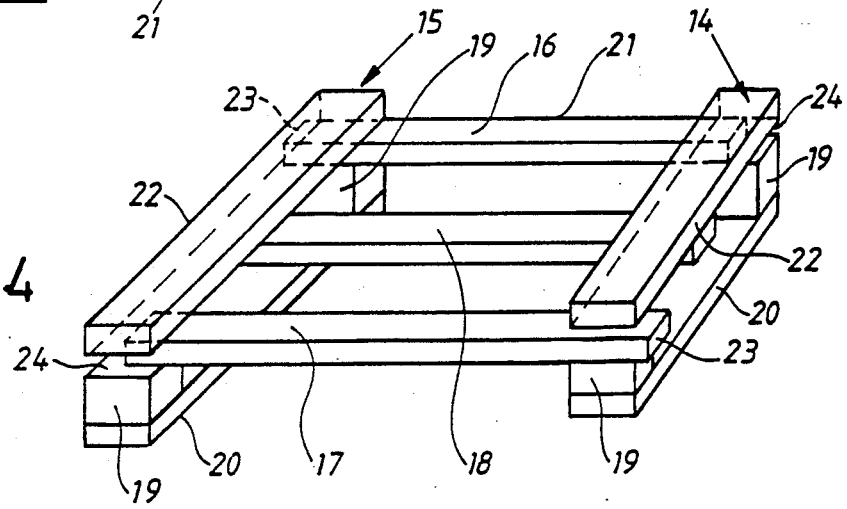
FIG. 4 is an enlarged perspective of a single pallet.

The pallet shown in FIGS. 3 and 4 comprises a frame made from wood, plastic or other suitable material. The frame has two elongated upper elements 14 and 15 which are substantially parallel to each other with one of the upper elements 14 being shorter than the other upper element 15. The top surface of the upper elements serve as a support surface for the load unit 10 being placed on the pallet. Each of the upper elements is rigidly connected to elongated transverse elements 16, 17 and 18 which are situated below the upper elements. The transverse elements 16 and 17 are fixed to spacer blocks 19 which are positioned at each corner of the structure forming the frame. The spacer blocks are connected to elongated bottom elements 20 which are substantially parallel with the upper elements 14 and 15. The upper elements, the transverse elements and the spacer blocks are arranged to that the outer vertical edges 21 of transverse element 16 and 17 form alternating projections 23 and recesses 24 at adjacent corners.

By placing four pallets next to each other as shown in FIG. 3, the projections 23 are engaged with the recesses 24 which causes the pallets to be locked together when the strap 13 is wrapped around the load units which are strapped to the individual pallets. The edges 21 form parallel even surfaces on opposing sides of the combined load.

In accordance with the preferred embodiment which has been described, each pallet comprising the combined load must assume a particular orientation relative to the other pallets. However, it is within the scope of the invention to provide a pallet which can assume either of two different orientations with respect to the other pallets used to form the combined load by rotating a properly orientated pallet by 180° . This can be achieved by shortening the farthest end of the elongated upper element 15 in FIG. 4, and extending the farthest end of the element 14 and the bottom element 20.

When a forklift is used to move the combined load, the longitudinal direction of all transverse elements should be perpendicular to the length of the lifting arms of the forklift, and the arms of the forklift should be of sufficient length to reach the middle transverse element 18 of the pallet farthest from the forklift to prevent tipping of the combined load during handling.

The bottom element 20 can be used to transport a single load unit from the combined load by means of a small transportation carriage when the distance between the transverse elements and the ground is too large to permit a lifting movement by means of such a transportation carriage.

It is within the scope of the invention to replace the locking means shown in the Figures with other equivalent locking means and to place the locking means at other places along the edges of the pallet.

It should be mentioned that on certain occasions it may be desirable to place protective material on the exterior surfaces of the combined load, particularly at the corners and edges, before the straps 13 are fastened.

What is claimed is:

1. A method for packing and transporting load units on pallets where each load unit is supported on a separate pallet and wherein four loaded pallets are placed next to each other before transportation and are fixed to each other to form a combined load for handling and transportation, characterized in that each pallet comprises:

first and second elongated upper elements substantially parallel to each other and having top surfaces which serve as supports for a load unit;

a plurality of substantially parallel, elongated transverse elements of substantially equal length, rigidly connected to the upper elements to form a substantially rectangular pallet;

a plurality of spacer blocks each being fixed to a transverse element near an end of an upper element;

first and second projections on opposite sides of the pallet formed by two of the transverse elements being longitudinally staggered in opposite directions so that one end of each staggered transverse element forms the first and second projections, respectively;

first and second recesses on opposite sides of the pallet adapted for receiving projections from adjacent pallets, said recesses being respectively formed by the other end of each staggered transverse element which separates one of the upper elements from one of the spacer blocks to form the recesses therebetween;

a third projection on a side adjacent the first projection;

a third recess on the same side as the third projection adapted to receive a projection similar to the third projection from an adjacent pallet; and before transportation, the pallets are moved in the same horizontal plane to abut and thereby engage substantially horizontal, parallel faces of recesses in one pallet with substantially horizontal, parallel faces of projections on two other pallets received in the recesses to become locked against vertical movement with respect to each other, after which the pallets are fixed to each other by placing a strap about the combined pallets.

2. A method according to claim 1, wherein the separate pallets and associated load units are fixed to each other before transportation.

3. A method according to claim 2, wherein the separate pallets and associated load units are fixed to each other by means of straps.

4. A method according to claim 1, wherein each of the separate load units are wrapped with a thin plastic layer before transportation.

5. A pallet according to claim 1, wherein the first and second projections are near first and second opposing corners of the pallet and the first and second recesses are near third and fourth opposing corners.

6. A pallet, comprising:

first and second elongated upper elements substantially parallel to each other and having top surfaces which serve as supports for a load unit;

a plurality of substantially parallel, elongated transverse elements of substantially equal length, rigidly connected to the upper elements to form a substantially rectangular pallet;

a plurality of spacer blocks each being fixed to a transverse element near an end of an upper element;

first and second projections on opposite sides of the pallet formed by two of the transverse elements being longitudinally staggered in opposite directions so that one end of each staggered transverse element forms the first and second projections, respectively;

first and second recesses on opposite sides of the pallet adapted for receiving projections from adjacent pallets, said recesses being respectively formed by the other end of each staggered transverse element which separates one of the upper elements from one of the spacer blocks to form the recesses therebetween;

a third projection on a side adjacent the first projection; and a third recess on the same side as the third projection adapted to receive a projection similar to the third projection from an adjacent pallet.

7. A pallet according to claim 6, wherein the first upper element is longer than the second upper element so that an end of the first upper element extends past an outer one of the transverse elements to form the third projection and an end of the second upper element, with the outer one of the transverse elements, forms the third recess.

8. A pallet according to claim 6, wherein the spacer blocks are located at the four corners of the pallet.

9. A pallet according to claim 6, further comprising first and second elongated bottom elements, substantially parallel to the upper elements and rigidly connected to the bottoms of the spacer blocks.

10. A pallet according to claim 6, wherein the first and second projections have substantially horizontal parallel upper and lower faces adapted to engage, respectively, substantially horizontal parallel lower and upper faces of first and second recesses on adjacent pallets.

* * * * *